US006170224B1

(12) United States Patent
Boyse et al.

(10) Patent No.: US 6,170,224 B1
(45) Date of Patent: Jan. 9, 2001

(54) MULTI-PANEL HOLLOW DOOR STRUCTURES AND MANUFACTURING METHODS EMPLOYING PAPERBOARD CORES

(75) Inventors: George C. Boyse, Rocklin; Richard S. Colombero, Sacramento, both of CA (US); David J. Wierzbicki, Homewood, IL (US)

(73) Assignee: Greif Bros. Corporation, Delaware, OH (US)

( * ) Notice: Under 35 U.S.C. 154(b), the term of this patent shall be extended for 0 days.

(21) Appl. No.: 09/292,003

(22) Filed: Apr. 15, 1999

(51) Int. Cl.[7] ..... E04C 2/54

(52) U.S. Cl. ..... 52/784.14; 52/783.12; 52/784.1; 52/784.15; 52/455; 52/745.19

(58) Field of Search ..... 52/783.12, 784.1, 52/784.14, 784.15, 455, 745.19

(56) References Cited

U.S. PATENT DOCUMENTS

| | | | | |
|---|---|---|---|---|
| 2,765,056 | | 10/1956 | Tyree . | |
| 3,385,002 | * | 5/1968 | Quinif | 52/784.14 |
| 4,130,682 | | 12/1978 | Lauko . | |
| 4,583,338 | * | 4/1986 | Sewell et al. | 52/784.14 |
| 4,811,538 | | 3/1989 | Lehnert et al. . | |
| 5,155,959 | | 10/1992 | Richards et al. . | |
| 5,167,105 | | 12/1992 | Isban et al. . | |
| 5,466,211 | | 11/1995 | Komarek et al. . | |
| 5,560,168 | * | 10/1996 | Gagne et al. | 52/784.1 |
| 5,582,571 | | 12/1996 | Simpson et al. . | |
| 5,681,641 | * | 10/1997 | Grigsby et al. | 52/783.12 |
| 5,690,601 | | 11/1997 | Cummings et al. . | |
| 5,875,608 | * | 3/1999 | Quinif | 52/784.14 |

* cited by examiner

*Primary Examiner*—Christopher T. Kent
*Assistant Examiner*—Dennis L. Dorsey
(74) *Attorney, Agent, or Firm*—Vorys, Sater, Seymour and Pease LLP

(57) ABSTRACT

A multi-panel hollow door has a core made of corrugated paperboard. The core is formed from a stack of plies in which adjacent plies are adhered to one another in accordance with a predetermined pattern of adherence (e.g., a gluing pattern). The stack is expanded in a direction perpendicular to the plies to form an elongated series of cells disposed longitudinally between transversely spaced panel indentations of a door skin, at a central region of the door. Each cell has a pair of transversely spaced vertices, and juxtaposed end portions of vertex-forming plies form tabs. Each tab is preferably oriented to overlap an adjacent portion of a vertex-forming ply, the desired orientation being obtained by partial slitting of a single vertex-forming ply. Unexpanded end portions of a stack of plies may be broken off to form pads between corresponding portions of the skins.

20 Claims, 4 Drawing Sheets

MULTI-PANEL HOLLOW DOOR STRUCTURES AND MANUFACTURING METHODS EMPLOYING PAPERBOARD CORES

BACKGROUND OF THE INVENTION

This invention is concerned with hollow structures such as multi-panel hollow doors having molded skins, and is more particularly concerned with improved paperboard cores for such doors.

Hollow doors with molded skins have become increasingly popular in recent years. Because the skins are flexible, it is necessary to provide some type of core, void filler, or separator between the skins to ensure the desired rigidity of the door. In doors having flat or flush skins without panels, the core may take the form of a simple multi-cellular structure (honeycomb) constituted of corrugated paperboard. However, a problem arises when a skin has panels defined by peripheral indentations, because the separation of the skins is not uniform.

One approach to solving this problem is to use a multi-cellular paperboard core in which the height of the cell walls varies to accommodate the indentations. However, this arrangement increases the complexity of core manufacture and door assembly. Another approach is to use a plurality of separate paperboard "build-ups" or pads between the skins, but this arrangement increases material requirements.

BRIEF DESCRIPTION OF THE INVENTION

The present invention provides a simpler, more economical solution to the problem of providing cores in hollow structures such as a multi-panel hollow doors.

In accordance with one aspect of the invention, a core is formed from a stack of paperboard plies in which adjacent plies are adhered to one another at predetermined positions in accordance with a predetermined pattern of adherence (e.g., a gluing pattern), such that the stack can be expanded in a direction perpendicular to the plies to form an elongated series of cells that can be readily placed longitudinally between transversely spaced panel indentations of a hollow door. In one embodiment, the pattern of adherence is such that portions of the stack remain unexpanded and form transversely extending wings between longitudinally spaced pairs of panel indentations, and also at the top and/or bottom of the door. In another embodiment, unexpanded end portions of the stack may be broken off to form pads which may be disposed between corresponding portions of the skins.

In a preferred form of multi-cellular paperboard core, each cell is hexagonal and has a pair of transversely spaced vertices, each vertex being formed by cell wall plies having juxtaposed end portions that are adhered to one another to form a tab. By virtue of discrete slitting of part of a vertex-forming ply, each tab is oriented to overlap an adjacent portion of that ply, which facilitates placement of the expanded core between transversely spaced panel indentations.

BRIEF DESCRIPTION OF THE DRAWINGS

The invention will be further described in conjunction with the accompanying drawings, which illustrate preferred (best mode) embodiments, and wherein.

DETAILED DESCRIPTION OF THE INVENTION

Figure 1:
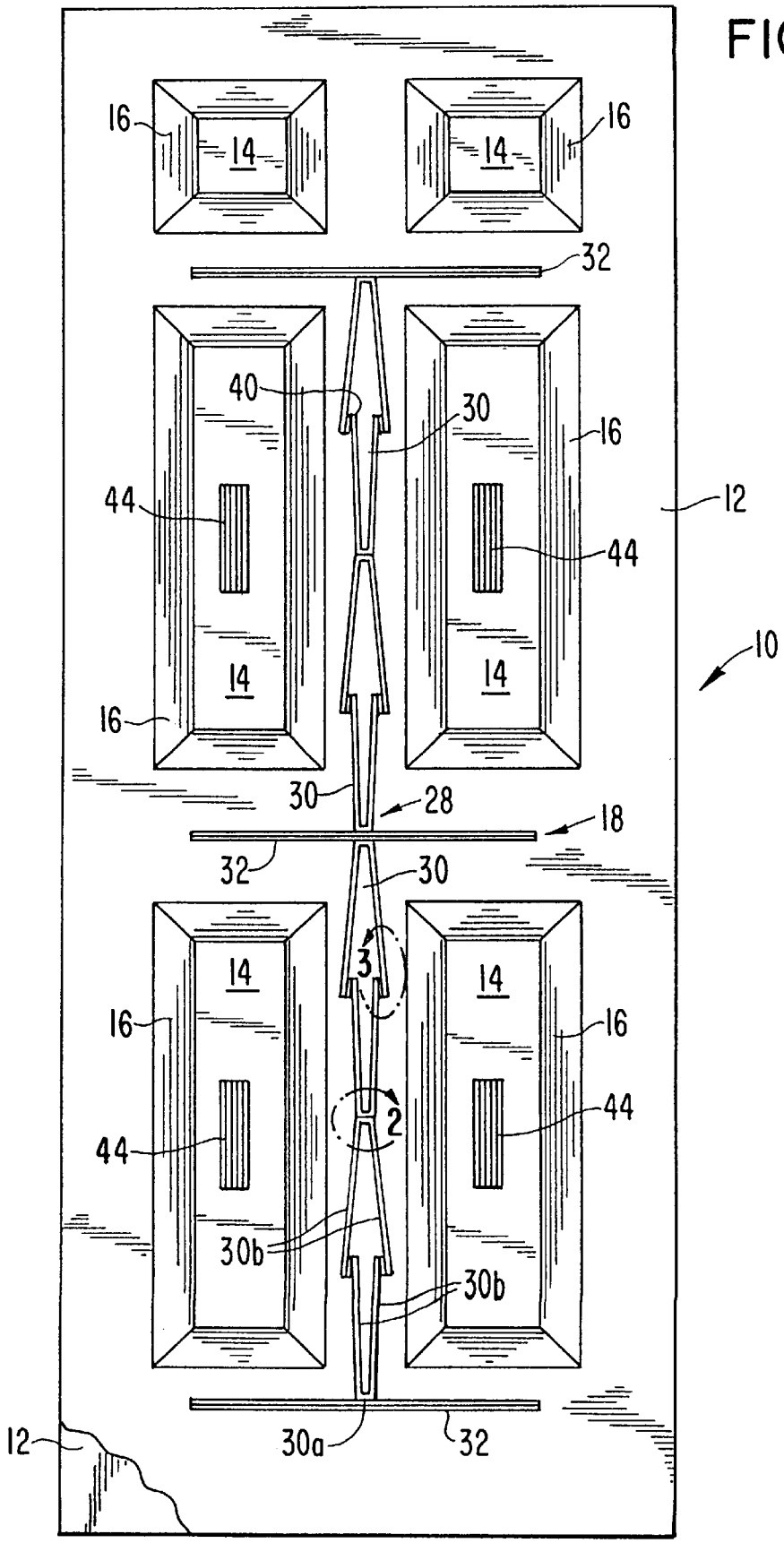
FIG. 1 is a plan view showing a hollow door structure employing a core in accordance with the invention.

FIG. 1 shows a multi-panel hollow door 10 comprising a pair of skins 12, one of which is shown fragmentarily to expose the hollow interior of the door. The skins are formed of a conventional material, such as "hardboard," for example, and are joined to a peripheral frame (not shown) in a conventional manner. At least one skin has pairs of transversely and longitudinally spaced panels 14 defined by peripheral molding indentations 16, the number and shape of which are dictated by the style of the door. Before final assembly of the door, in which the skins are adhered to the frame, the void between the skins is provided with a core 18, sometimes referred to as a void filler or separator, that ultimately becomes adhered to the skins, as in conventional hollow door assembly. The core of the invention is unique, as will become apparent in the following description.

Figure 2:
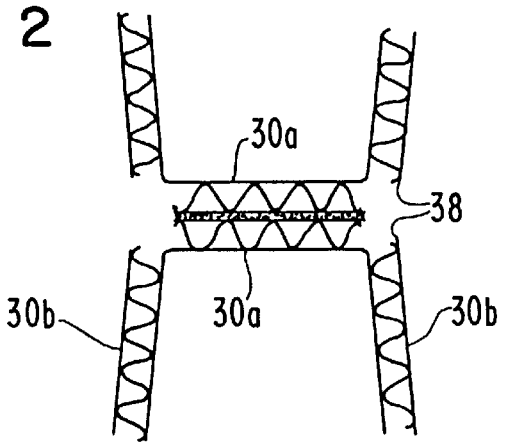
FIGS. 2 and 3 are fragmentary enlarged plan views showing portions of the core shown in FIG. 1.
Figure 3:
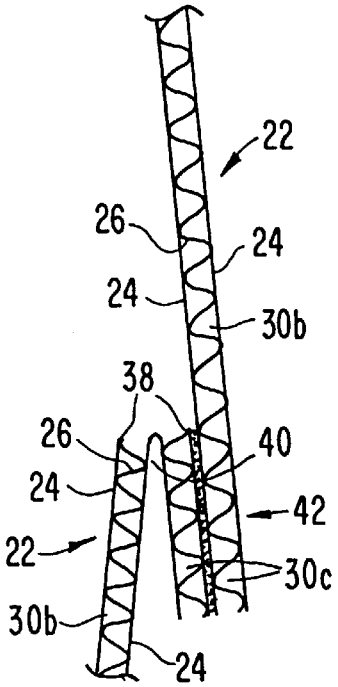
Figure 4:
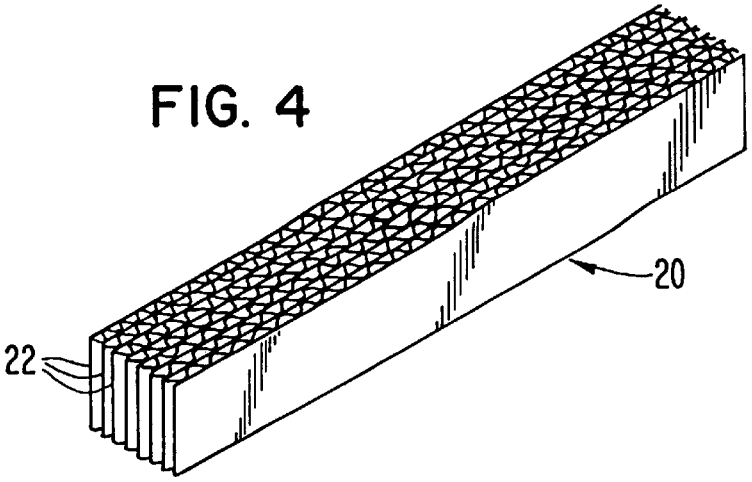
FIG. 4 is a perspective view of a stack of paperboard plies from which a core is formed.

As shown in FIG. 4, in a preferred embodiment the core starts as a generally rectangular stack 20 of corrugated paperboard plies 22. As shown in FIGS. 2 and 3, each ply 22 is constituted by a pair of flat sheets of paper 24 separated by a sinuous paper filler 26, as is well known. The stack 20 shown in FIG. 4 may be cut from a much larger workpiece.

In accordance with the invention, as shown in FIG. 1 the stack 20 is expanded in a direction perpendicular to the plies 22 to form an elongated series 28 of preferably hexagonal cells 30, four such cells being seen in FIG. 1. Each cell has a pair of opposite short end walls 30*a* and a pair of longer side walls 30*b* extending from each end wall.

Portions of the stack remain unexpanded to form wings 32 integral with the series of cells and extending transversely across the series of cells, as later explained.

Figure 5:
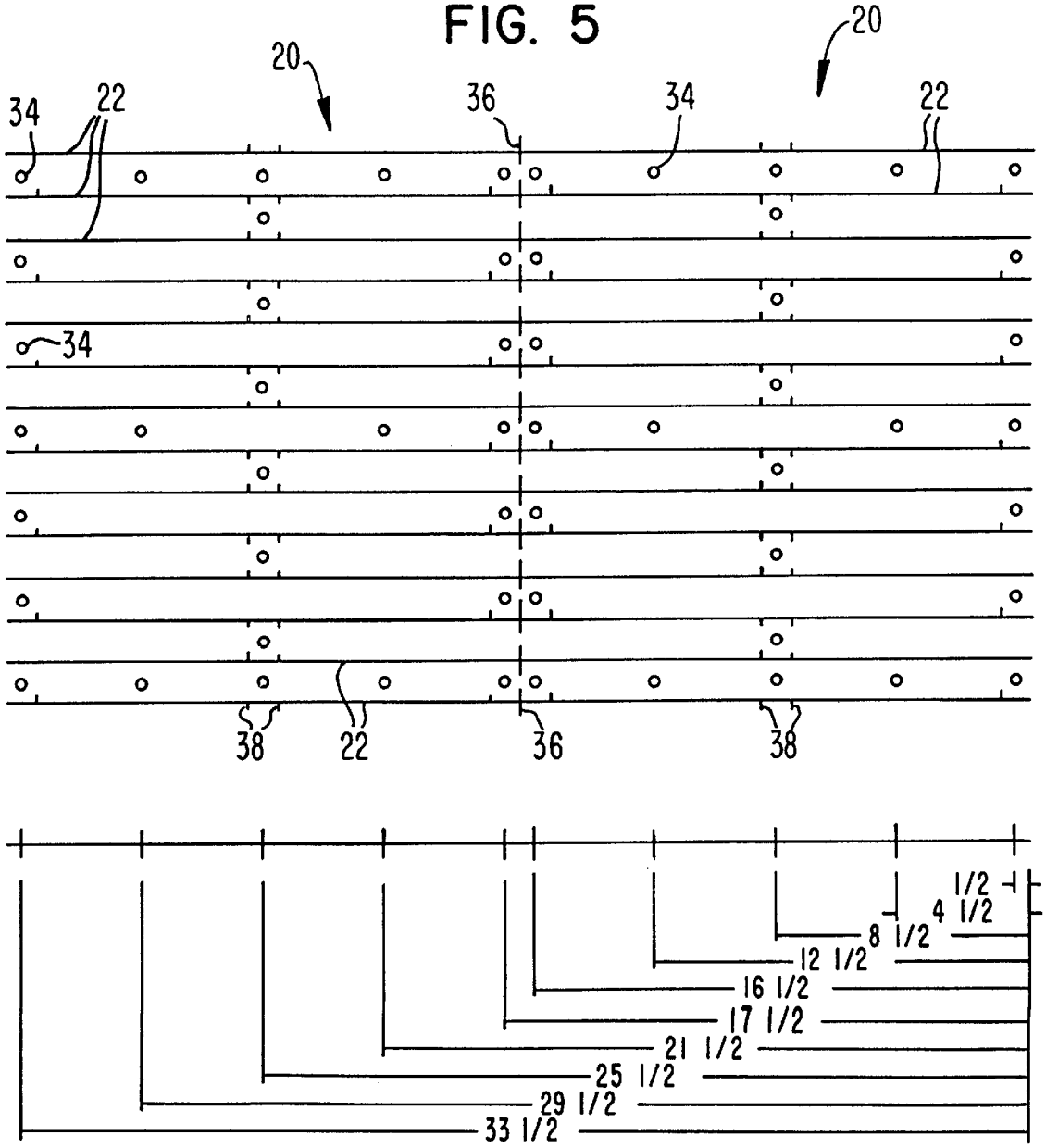
FIGS. 5 and 6 are diagrams showing patterns of adherence and slitting of stacks of plies from which cores are formed.

In order to provide a core 18 as just described, adjacent plies 22 of the stack 20 are adhered to one another at predetermined positions in accordance with a predetermined pattern of adherence (e.g., a gluing pattern). A typical pattern is shown in FIG. 5, in which each horizontal line represents a ply 22 of a 14-ply dual stack, and each circle 34 represents the center of a line of glue between adjacent plies. At some positions in the pattern, the gluing provides for the formation of cells when the stack is expanded. At other positions, the gluing ensures that portions of the stack remain unexpanded to form the wings.

Since the dual stack of FIG. 5 is intended to form two cores, lines of weakness are provided by perforating the plies at central positions, as indicated by vertical lines 36, to permit the left and right halves to be separated into two stacks 20. Vertical lines 38 designate the positions of discrete slits that facilitate bending of adjacent plies to form the short end walls 30*a* of adjacent cells, as shown in FIG. 2, and to form transversely spaced cell vertices 40, one of which is shown in FIG. 3., when the stack is expanded.

As shown in FIG. 3, each vertex 40 is formed by plies of a pair of side walls 30*b* having juxtaposed end portions 30*c* adhered to one another. By virtue of the fact that only one sheet 24 and the sinuous filler 26 of a ply of only one of the vertex-forming cell walls is slit (i.e., without slitting the other sheet 24 of the ply), when the stack of plies is expanded, each pair of juxtaposed end portions 30*c* forms a tab 42 that is oriented so that it overlaps an adjacent portion of the ply subjected to the slitting, i.e., the orientation of the tabs in the series of cells is substantially longitudinal. In the absence of such slitting and orientation, the tabs would project outwardly from the expanded structure and would tend to interfere with transversely spaced indentations 16 during placement of the expanded structure, making assembly more difficult.

The dual stack shown in FIG. 5 provides cores for two molded skin doors of the type shown in FIG. 1, such as a 30 inch by 80 inch hollow six-panel door. Each stack is constituted by 14 plies 17 inches long. Considered from the top of the stack, the first two plies form a wing 32 below a pair of small panels 14 near the top of the door. The next four plies form two cells between a pair of large panels 14. The next two plies form a wing 32 below that pair of panels 14. The next four plies form two cells between a further pair of large panels 14. The two plies at the bottom of the stack form a wing 32 adjacent to the bottom of the door.

As is apparent in FIG. 5, the pattern of adherence provided by the gluing lines is predetermined such that some of adjacent plies in each stack are adhered to one another only at their ends, and each of those plies is adhered to another adjacent ply only at their center. The pattern of adherence is also predetermined such that some of the plies of the stack remain juxtaposed with adjacent plies throughout the length of the stack, to form transversely extending wings of the core when the stack is expanded.

Figure 6:
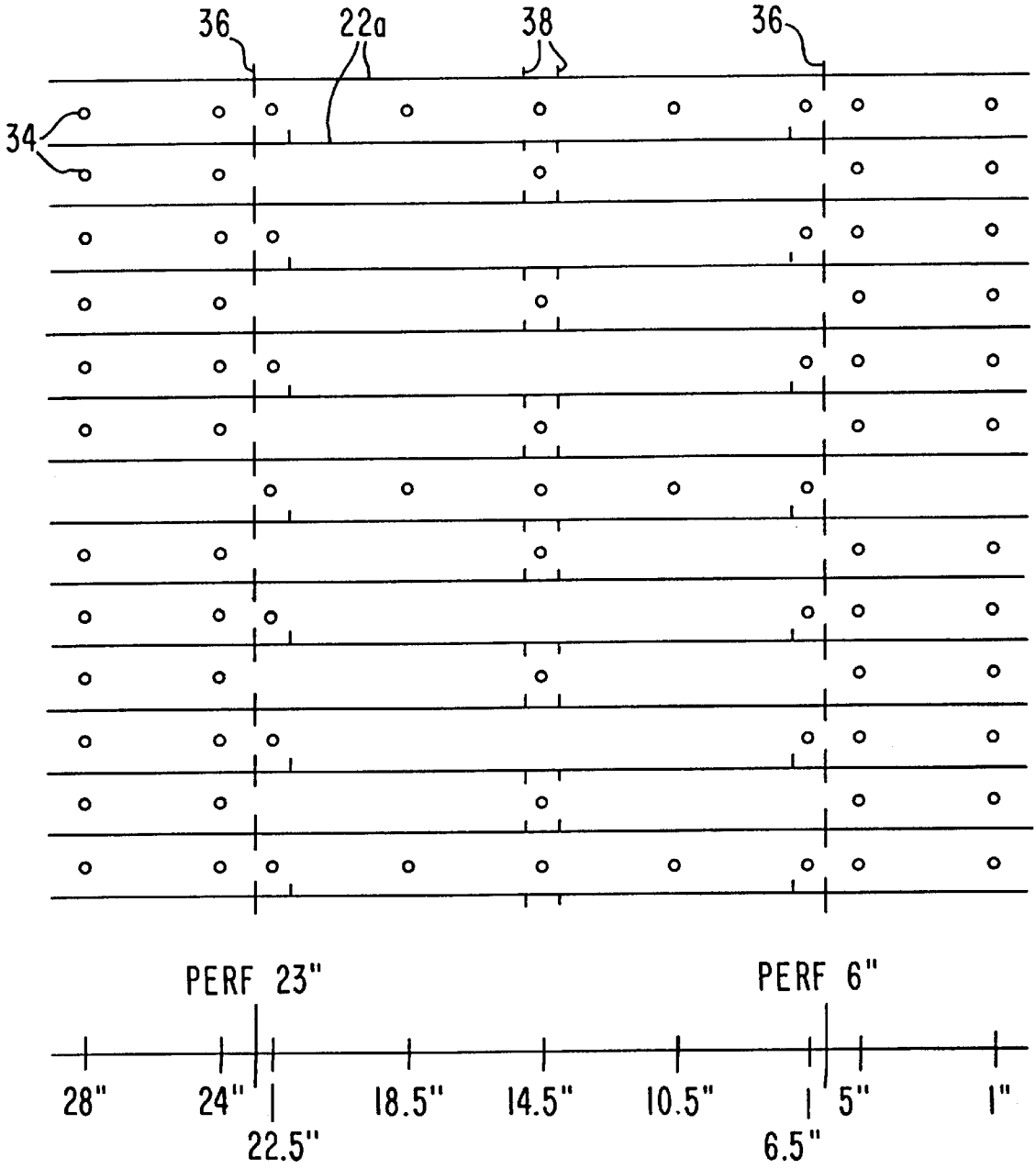

FIG. 6 shows the plan of a stack of plies in which adjacent plies 22*a* at opposite end portions of the stack are adhered to one another in a manner that provides four build-ups or pads when the end portions are broken off from the stack by virtue of lines of weakness 36 in the plies. Except for the end portions, the stack shown in FIG. 6 is similar to half of the dual stack shown in FIG. 5.

Build-ups or pads 44 may be formed from end portions of a stack of plies, as described above, or from a separate stack in which adjacent plies are adhered to one another so as to remain juxtaposed, plies of the stack being provided with lines of weakness to permit the stack to be broken into multiple build-ups or pads. In FIG. 1, the core comprises four build-ups or pads 44 placed on corresponding panels 14.

In the door shown in FIG. 1, there are six panel indentations arranged in pairs spaced transversely and longitudinally of the door. The multi-cell expanded portion of the core is limited to a central region of the door between pairs of transversely spaced indentations. Multi-ply wings 32 are integral with the multi-cell expanded portion and extend transversely therefrom continuously across the central region of the door.

The number of cells in a multi-cell expanded portion, and the number and location of the wings, can be chosen to meet the needs of particular doors. In FIG. 1, there are four cells and three wings, with two cells between each pair of wings. Alternatively, there may be a wing adjacent to the top of the door and a wing adjacent to the bottom of the door and a series of eight cells, for example, between the wings. In another variation, there may be three wings as in FIG. 1, and there may be six cells, three cells between each pair of wings. In another variation, in a 4-panel door, there may be a first wing near the top of the door and a second wing between two pairs of panels, with two cells between the pair of wings and three cells below the second wing. The number of plies in the wings of any embodiment can be chosen to meet particular needs.

In another modification, a large door panel may be provided, internally of its peripheral molding, with its own large expanded core comprising a series of cells with integral multi-ply wings. To fill out the panel, several series of cells may be provided, integrally joined to each other and to the wings.

It should be noted that one of the main advantages of the invention is a significant savings of material, when compared with prior paperboard cores consisting entirely of build-ups.

While preferred embodiments of the invention have been shown and described, modifications can be made without departing from the principles and spirit of the invention, the scope of which is defined in the accompanying claims.

What is claimed is:

1. In a hollow structure having a core between a pair of spaced skins, at least one of which has a pair of spaced indentations, the improvement wherein the core comprises a multi-cell expanded portion extending between the spaced indentations, and at least one unexpanded portion integral with the expanded portion and forming a wing extending across the expanded portion.

2. A structure according to claim 1, wherein there are pairs of longitudinally and transversely spaced indentations, and the core has a plurality of said unexpanded portions forming wings that extend across the expanded portion at the top and/or the bottom of the structure and/or between pairs of longitudinally spaced indentations.

3. A structure according to claim 2, wherein the core is formed of corrugated paperboard plies.

4. A structure according to claim 3, wherein cells of the expanded portion are hexagonal and are elongated longitudinally of the structure.

5. A structure according to claim 4, wherein each cell has a pair of transversely spaced vertices, each vertex being formed by a pair of cell wall plies having juxtaposed end portions adhered to one another to form a tab.

6. A structure according to claim 5, wherein each ply includes a pair of substantially flat sheets spaced apart by a sinuous filler, and wherein each cell has longitudinally spaced ends at which two plies are adhered to one another, the transversely spaced vertices of each cell being formed by the same plies that form the cell ends, each vertex having a slit through only one of the sheets and the sinuous filler of one of the plies forming the vertex, whereby each tab is oriented to overlap an adjacent portion of one of the plies forming the vertex.

7. A structure according to claim 1, wherein the core further comprises multi-ply pads extending between corresponding portions of the skins.

8. A structure comprising a substantially rectangular stack of paperboard plies, the plies being adhered to adjacent plies according to a predetermined pattern of adherence that permits the stack to be expanded in a direction perpendicular to the plies of the stack to form a series of cells, each cell being formed by a pair of adjacent plies of the stack that form a pair of longitudinally spaced cell ends and a pair of transversely spaced cell vertices, and wherein some adjacent plies of the stack are adhered to one another so as to maintain those plies juxtaposed with one another throughout the length of the stack.

9. A structure according to claim 8, wherein an end portion of the stack is constituted by a plurality of ply portions that are adhered to each other so as to form a pad, and wherein plies of the stack are provided with lines of weakness to permit the pad to be broken off from the stack.

10. In the manufacture of a hollow structure having a core between a pair of skins, at least one of which has a pair of transversely spaced indentations, a method of providing the core that comprises:

forming a substantially rectangular stack of corrugated paperboard plies in which adjacent plies are adhered to one another at predetermined positions in the stack in accordance with a predetermined pattern of adherence, such that some of adjacent plies are adhered to one another at first and second positions spaced along the length of the stack and each of those plies is adhered to another adjacent ply at a third position between the first and second positions;

expanding the stack in a direction perpendicular to the plies to form an elongated series of cells, the predetermined pattern of adherence being such that some of the plies of the stack remain juxtaposed with adjacent plies throughout the length of the stack to form transversely extending wings integral with the series of cells and extending across the series of cells when the stack is expanded; and disposing the series of cells at a region between the transversely spaced indentations, with the wings extending transversely across the series of cells at predetermined positions.

11. A method according to claim 10, wherein adjacent plies at an end portion of the stack are adhered to one another so as to maintain those plies juxtaposed to form a pad, and wherein plies of the stack are provided with lines of weakness between the pad and an adjacent portion of the stack, said method further comprising breaking off the pad from the stack and disposing the pad between corresponding portions of said skins.

12. A method according to claim 10, wherein each of cells of the series has a pair of transversely spaced cell wall vertices, and each vertex has an external tab that extends integrally therefrom and is oriented to overlap a cell wall portion adjacent to the vertex.

13. A structure for forming a void filler, comprising a stack of plies in which some of adjacent plies are adhered to one another at end portions of those plies, and each of those plies is adhered to another adjacent ply centrally, and in which some of adjacent plies are adhered to one another so as to maintain them juxtaposed, whereby the stack can be expanded in a direction perpendicular to the plies to form an elongated series of cells and to form at least one wing integral with the series of cells and extending transversely across the series of cells.

14. A structure for forming a void filler, comprising a stack of plies in which adjacent plies of the stack are adhered to one another in accordance with a predetermined pattern of adherence that provides for the expansion of the stack in a direction perpendicular to the plies to form a series of cells, and in which, at an end portion of the stack, adjacent plies are adhered to one another to maintain them juxtaposed, and wherein lines of weakness are provided in plies of the stack to permit the end portion to be broken off to form a pad.

15. A structure according to claim 14, wherein some of adjacent plies are adhered to one another so as to maintain them juxtaposed when the stack is expanded.

16. A method of making a void filler, comprising:

forming a substantially rectangular stack of plies in which adjacent plies are adhered to one another at predetermined positions in the stack in accordance with a predetermined pattern of adherence, said pattern being such that some of adjacent plies are adhered to one another at end portions, each of those plies is adhered to another adjacent ply at a central portion, and some of adjacent plies are adhered to one another so as to maintain those plies juxtaposed; and expanding the stack in a direction perpendicular to the plies to form a series of cells and at least one unexpanded wing integral with the series of cells and extending across the series of cells.

17. A method according to claim 16, wherein the plies are formed of corrugated paperboard and said end portions and central portions are slit at predetermined positions to facilitate bending of plies to form the cells when the stack is expanded.

18. A method according to claim 17, wherein the pattern of adherence is such that hexagonal cells are formed when the stack is expanded.

19. A method according to claim 18, wherein each cell has a pair of end walls and each end wall has a side wall extending therefrom and adhered to a similar side wall extending from an opposite end wall to form a vertex with a tab extending therefrom.

20. A method according to claim 19, wherein one side wall at each vertex is slit so that the tab overlaps an adjacent portion of that side wall when the stack is expanded.

* * * * *